US008002158B1

(12) United States Patent
West

(10) Patent No.: US 8,002,158 B1
(45) Date of Patent: Aug. 23, 2011

(54) FIELD COOKING TRAVEL KIT

(76) Inventor: Mary Frances West, Baltimore, MD (US)

( * ) Notice: Subject to any disclaimer, the term of this patent is extended or adjusted under 35 U.S.C. 154(b) by 0 days.

(21) Appl. No.: 12/877,974

(22) Filed: Sep. 8, 2010

Related U.S. Application Data

(63) Continuation of application No. 12/290,085, filed on Oct. 27, 2008, now abandoned.

(51) Int. Cl.
*A45F 5/00* (2006.01)

(52) U.S. Cl. ..... 224/223; 224/682; 206/541; 206/549; 2/49.2

(58) Field of Classification Search ..... 206/235, 206/541, 542, 546, 553, 306, 218, 576; 2/49.1, 2/49.2; 224/223, 682
See application file for complete search history.

(56) References Cited

U.S. PATENT DOCUMENTS 1,659,114 A * 2/1928 McDonald ..... 190/12 R
3,181,751 A * 5/1965 Wilson ..... 383/39
3,749,233 A * 7/1973 McCormick, Jr. ..... 206/373
4,715,499 A * 12/1987 Franklin ..... 206/373
4,993,614 A * 2/1991 Bonofiglo ..... 224/665
5,174,447 A * 12/1992 Fleming ..... 206/373
5,240,156 A * 8/1993 Sicotte et al. ..... 224/583
D352,260 S * 11/1994 Adamo ..... D12/133
D358,473 S * 5/1995 Taylor ..... D2/864
5,427,239 A * 6/1995 Hunt ..... 206/372
D381,190 S * 7/1997 Deon ..... D2/863
5,692,604 A * 12/1997 Houk ..... 206/278
5,813,080 A * 9/1998 Hendren ..... 15/209.1
5,902,661 A * 5/1999 Oster ..... 428/82
6,000,509 A * 12/1999 Chisholm ..... 190/109
D445,564 S * 7/2001 Brookhouse ..... D3/206
D461,945 S * 8/2002 Byrd ..... D2/864
6,464,098 B1 * 10/2002 Henson et al. ..... 220/475
6,473,905 B1 * 11/2002 Katz ..... 2/48
D471,011 S * 3/2003 Kowalsky ..... D3/299
7,552,904 B2 * 6/2009 Zehnder et al. ..... 248/682
2001/0037542 A1 * 11/2001 Elliott ..... 24/3.11
2002/0029400 A1 * 3/2002 Smith ..... 2/48
2003/0029770 A1 * 2/2003 MacKinnon ..... 206/553
2006/0053523 A1 * 3/2006 McNamara ..... 2/48
2006/0108240 A1 * 5/2006 MacKinnon ..... 206/223
2008/0023515 A1 * 1/2008 Coonan et al. ..... 224/682

* cited by examiner

*Primary Examiner* — David T Fidei
(74) *Attorney, Agent, or Firm* — Bryant L. Young

(57) ABSTRACT

A field cooking travel kit for providing cooking accessories for use in camping and traveling is provided. The field cooking travel kit comprises a plurality of cooking utensils and a carrying case for receiving the utensils wherein the carrying case provides reachable access to the utensils.

9 Claims, 1 Drawing Sheet

FIELD COOKING TRAVEL KIT

The present application is a continuation of U.S. application Ser. No. 12/290,085, filed Oct. 27, 2008, which claims priority to U.S. Provisional Appl. No. 61/001,978, filed Nov. 6, 2007, in which these applications are incorporated herein by reference.

BACKGROUND OF THE INVENTION

1. Field of the Invention

This invention relates generally to a field cooking travel kit and, more particularly, the invention relates to a field cooking travel kit comprising a well organized, basic set of cooking utensils designed for use in camping and traveling.

2. Description of the Prior Art

Whether an overnight camping trip to the mountains or seacoast, a Saturday afternoon's tailgating and football game, a family picnic in the city park, or a weekend on the lake with sailor motor, there are plenty of situations in which a mother (or any adult, for that matter) is called upon to cook "in the field". To most of us, equipping ourselves with a field kitchen means ransacking our indoor kitchen for the basic necessities, i.e., knives, can-opener, measuring cups, potato peelers, stirring spoons, etc., and then tossing these utensils, pell-mell, into a hastily chosen box or plastic bag. If we are lucky, we will get through a weekend of reaching into that box or bag without nicking ourselves on the blade of the paring knife; if we're unlucky, we'll nick our fingers, lose our favorite paring knife, break our only can-opener, and see our good stirring spoons used to stir a campfire. In any event, the hit-or-miss, grab-and-go, load-em-up-and-head-em-out arrangement is poorly organized and hardly satisfying and pilfering our real kitchen before we go to the woods is never a great idea, because our real kitchen inevitably suffers when we get home.

For the outdoor-loving family, however, there are not great many alternatives. We can easily assemble a first-rate set of nested, stainless steel pots and pans at any good camping store. But the basic tools are harder to come by, and generally must be purchased piece by piece and then lost the same way. What we need is a basic set of cooking tools, of utensils, packaged sensibly and securely for transport and for use in the field.

SUMMARY

The present invention is a field cooking travel kit for providing cooking accessories for use in camping and traveling. The field cooking travel kit comprises a plurality of cooking utensils and a carrying case for receiving the utensils wherein the carrying case provides reachable access to the utensils.

The present invention further includes a method for providing cooking accessories for use in camping and traveling. The method comprises providing a plurality of cooking utensils, providing a carrying case, inserting the utensils in the carrying case, and accessing the utensils in the carrying case.

DETAILED DESCRIPTION OF THE PREFERRED EMBODIMENTS

Figure 2:
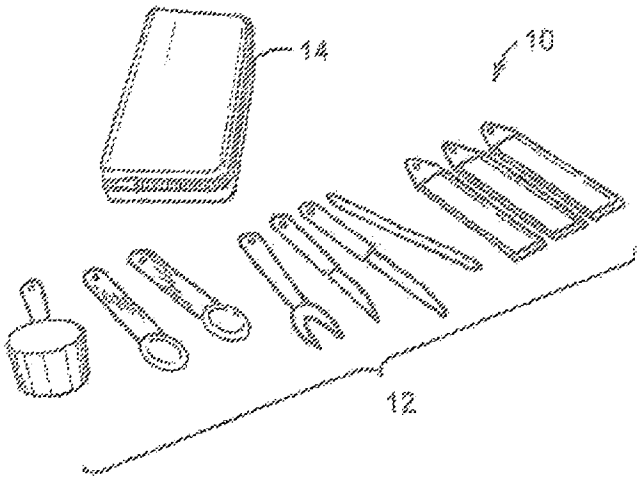
FIG. 2 is a perspective view illustrating a carrying device and utensils for a field cooking travel kit, constructed in accordance with the present invention.
Figure 1:
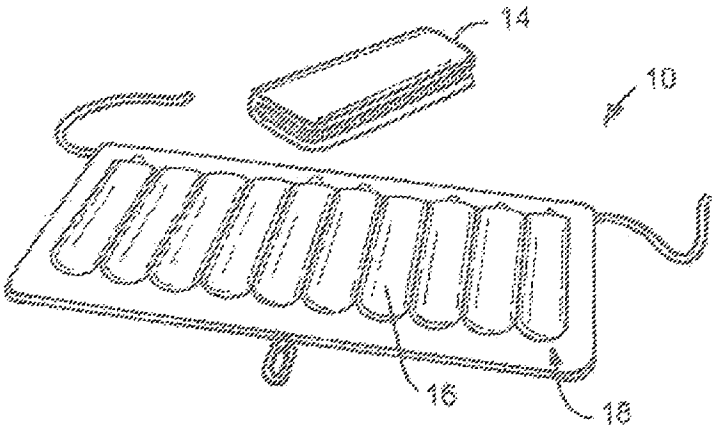
FIG. 1 is a perspective view illustrating carrying devices for a field cooking travel kit, constructed in accordance with the present invention.

As illustrated in FIGS. 1 and 2, the present invention is a field cooking travel kit, indicated generally at 10, comprising a well organized, basic set of cooking utensils 12 designed for use in camping and traveling. Simply stated, the field cooking travel kit 10 of the present invention provides a mother (or anyone else in the Chef Mom role) with the essential tools for field cooking. The utensils 12 include, at minimum, a teaspoon, a tablespoon, a meat fork; a meat thermometer; a paring knife; a carving knife; a strainer; a grater; a magnifying glass; a corkscrew; and a measuring cup. Beyond these, it might be desirable to include a can-opener; perhaps three stirring spoons, both slotted and solid; a potato peeler; and perhaps a flat spatula. The end user can determine the number and assortment of cooking utensils 12.

Preferably, the cooking utensils 12 of the field cooking travel kit 10 are manufactured of high-grade stainless steel, with a simple, rugged design and, where appropriate, sturdy injection-molded thermoplastic handles. The field cooking travel kit 10 includes all components in a compact, well-designed package, and everything done with high quality.

In the field cooking travel kit 10 of the present invention, the various utensils 12 preferably conform to a general size limitation of approximately seven (7") inches in length by approximately two (2") inches in width, such that the entire outfit can be stored within a zipped pouch 14 having dimensions of approximately seven and one-quarter (7¼") inches long by approximately two and one-quarter(2¼") inches wide. The magnifying glass, grater, and strainer are preferably rectangular in shape, measuring approximately seven (7") inches by approximately two (2") inches; the measuring cup is preferably a collapsing concentric-ring style collapsing to be approximately one-half (½") inch in depth (it too would fit into the pouch). The exterior surface of the measuring cup can be imprinted with one (1) cup, three-quarters (¾) cup, one-half (½) cup, and one-quarter (¼) cup measurements.

The field cooking travel kit 10 of the present invention can be made available in several versions or models: one would be the pouch kit 14 just described here. A second version offers the same utensils 12, but presents them not in a pouch 14, but held in separate slots or compartments 16 of a belt 18 similar to a tool-belt. And, a third version includes the same utensils, but present them as part of a camping apron which features ten (10) deep vertical pockets for the storage of these and other utensils 12. New utensils can be added as their need and relevance are seen, or suggested by customers. For example, a fish camp kit can include a hook-disgorger and a fish-scaler; and the hunting lodge kit might include a meat-tenderizing mallet. The field cooking travel kit 10 can easily be large enough to encourage the camping mom to customize and expand her outfit, as she desires. The apron and belt 18 models might also incorporate some accessory D-rings or carabineer-style clips, for securing cooking towels, potholders, and other such hardware.

The field cooking travel kit 10 of the present invention, a self-contained set of basic utensils 12 for cooking in the field, presents a number of distinct and significant benefits and advantages. Foremost, the field cooking travel kit 10 provides all the essential field-cooking utensils 12 in one compact, easily portable case. With the field cooking travel kit 10, mom (or whoever is doing the cooking!) has no need to go through the kitchen drawers, taking her permanent utensils "on leave", she can simply grab the field cooking travel kit, knowing that she has everything she needs, in one place, ready to go. Again, the field cooking travel kit 10 contains not only the tools a person needs, but also a safe and secure place to keep them.

And when it comes to camp cooking, organization is almost as important as the equipment itself. With the field cooking travel kit 10 of the present invention, each tool or utensil 12 can be easily found in the zippered storage case 14, or in the dedicated pockets of the belt 18 or apron model. Another great advantage of the field cooking travel kit 10 is that the outfit can grow as the mom in question refines her camp-cooking expertise. With the belt 18 and apron models, she has room for her outfit to grow, utensil by utensil, as new needs arise. Thus, over time, her initial kit expands as the need arises, and the number of utensils grows. And, since every camp mom will have different needs in this regard, she is free to customize her kit to her own individual requirements. The components of the field cooking travel kit 10 are manufactured of high-grade stainless steel, for a long life of camp use; and because the overall travel kit design is found in each utensil, separating the utensils 12 from the other utensils in the washbasin is be an easy matter, thus helping to keep the set together. On multifamily camping trips or tailgating parties, this is an important consideration, as one's utensils might otherwise go home with one's neighbors or friends.

The field cooking travel kit 10 of the present invention presents an active, outdoor mom (or other camp cook) with all the basic utensils 12 she would need for cooking away from home, in a well-organized storage pouch, belt, or apron. Equally suited to car camping, boating, and a variety of other outdoor situations, the field cooking travel kit 10 is ready to go at a moment's notice, and makes packing up for a weekend trip a simple matter.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A method of using a field cooking travel kit for providing cooking accessories for use in camping and traveling, the method comprising:

providing a plurality of cooking utensils, providing a carrying case having a plurality of elongated slots spaced completely across the carrying case, the slots sized and shaped for receiving the utensils, providing accessory D-rings or carabineer-style clips for securing cooking towels, potholders, and other hardware, attaching the carrying case to a user so as to provide a wearable belt pouch having separate compartments for holding an individual utensil, wherein the carrying case provides reachable access to the utensils; and, placing the cooking utensils within the compartments.

2. The method of claim 1, wherein utensils include a teaspoon, a tablespoon a meat fork, a meat thermometer, a paring knife, a carving knife, a strainer, a grater, a magnifying glass, a corkscrew, and a measuring cup.

3. The method of claim 2, wherein the magnifying glass, the grater, and the strainer are substantially rectangular in shape.

4. The method of claim 2, wherein the measuring cup is collapsible and imprinted with one (1) cup, three-quarters (¾) cup, one-half (½) cup, and one quarter (¼) cup measurements.

5. The method of claim 2, wherein the utensils include a can opener, a plurality of stirring slotted and solid stirring spoons, a potato peeler, and a flat spatula.

6. The method of claim 1, wherein the utensils are constructed of high-grade stainless steel, and further wherein at least one of the utensils has an injection-molded thermoplastic handle.

7. The method of claim 1, wherein the utensils conform to a general size limitation of about approximately seven (7") includes in length by approximately two (2") in width.

8. The method of claim 1, wherein the carrying case is a pouch having dimensions of approximately seven and on-quarter (7¼") inches long by two and on-quarter (2¼") inches wide.

9. The method of claim 1, wherein the wearable belt pouch has a first end and a second end, a first string extends from the first end, a second string extends from the second end, the first string and the second string tieable together behind a user to releasably secure the wearable belt pouch to the user.

* * * * *